US009091475B2

(12) United States Patent
Kang et al.

(10) Patent No.: US 9,091,475 B2
(45) Date of Patent: Jul. 28, 2015

(54) DIAGNOSTIC METHOD FOR A REFRIGERATOR AND REFRIGERATOR USING THE SAME

(71) Applicant: LG ELECTRONICS INC., Seoul (KR)

(72) Inventors: Daejong Kang, Changwon-Si (KR); Minjin Oh, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 278 days.

(21) Appl. No.: 13/737,560

(22) Filed: Jan. 9, 2013

(65) Prior Publication Data

US 2013/0174586 A1 Jul. 11, 2013

(30) Foreign Application Priority Data

Jan. 10, 2012 (KR) ..... 10-2012-0003102

(51) Int. Cl.
*G06F 1/26* (2006.01)
*F25D 29/00* (2006.01)

(52) U.S. Cl.
CPC ..... *F25D 29/00* (2013.01)

(58) Field of Classification Search
USPC ..... 713/323, 324
See application file for complete search history.

(56) References Cited

U.S. PATENT DOCUMENTS

| | | | | |
|---|---|---|---|---|
| 2003/0167785 | A1* | 9/2003 | Roh et al. | 62/231 |
| 2005/0268624 | A1* | 12/2005 | Voglewede et al. | 62/126 |
| 2008/0119273 | A1* | 5/2008 | Yamada et al. | 463/39 |
| 2008/0184719 | A1* | 8/2008 | Lowenstein | 62/127 |
| 2010/0300130 | A1* | 12/2010 | Shoenfeld et al. | 62/129 |
| 2011/0251807 | A1* | 10/2011 | Rada et al. | 702/61 |
| 2013/0106613 | A1* | 5/2013 | Lee et al. | 340/691.3 |
| 2013/0113928 | A1* | 5/2013 | Feldman | 348/143 |

FOREIGN PATENT DOCUMENTS

| | | | |
|---|---|---|---|
| CN | 1186939 | A | 7/1998 |
| CN | 1683892 | A | 10/2005 |

* cited by examiner

*Primary Examiner* — Vincent Tran
(74) *Attorney, Agent, or Firm* — Birch, Stewart, Kolasch & Birch, LLP

(57) ABSTRACT

The present disclosure relates to a diagnostic method of a refrigerator using the same, and according to an aspect of the present disclosure, there is provided a diagnostic method of the refrigerator, and the method may include sensing power supplied thereto; determining whether or not a power failure has occurred based on the sensed power; storing power failure occurrence information when it is determined that the power failure has occurred; referring to the power failure occurrence information when the power supply is resumed; storing power failure end information when the power failure occurrence information is found; and providing the power failure occurrence and power failure end information.

13 Claims, 4 Drawing Sheets

DIAGNOSTIC METHOD FOR A REFRIGERATOR AND REFRIGERATOR USING THE SAME

CROSS-REFERENCE TO RELATED APPLICATIONS

The present disclosure relates to subject matter contained in priority Korean Application No. 10-2012-0003102, filed on Jan. 10, 2012, which is herein expressly incorporated by reference in its entirety.

BACKGROUND OF THE INVENTION

1. Field of the Invention

The present disclosure relates to a refrigerator diagnostic method and a refrigerator using the same, and more particularly, to a method of checking whether or not there is a power failure during the operation of the refrigerator and notifying it to the user and a refrigerator using the same.

2. Description of the Related Art

In general, refrigerator is an apparatus for storing goods such as foods, beverages and the like to keep them fresh for a long period of time, and they are stored in a freezing or refrigerating state based on the kind of the good to be stored.

Such a refrigerator is operated by driving a compressor provided therein. Cool air supplied to an inner portion of the refrigerator is generated by the operation of heat exchange with refrigerant, and continuously supplied to an inner portion of the refrigerator while repeatedly performing compression-condensation-expansion-evaporation cycles, and the supplied refrigerant is uniformly transferred to an inner portion of the refrigerator, thereby allowing foods within the refrigerator to be stored at a desired temperature.

On the other hand, power should be continuously supplied to the refrigerator to perform the foregoing cooling function and normally operate the refrigerator, but the cooling function may not be carried out when power is not normally supplied thereto. If a power failure occurs and thus foods are spoiled, then they should be thrown away.

However, when power is temporarily failed and then resumed again while the user is out for a long period of time, the user may not know whether or not there has been a power failure and thus it should be notified to the user.

SUMMARY OF THE INVENTION

The present disclosure is contrived to overcome the foregoing requirements, and a technical task of the present disclosure is to provide a diagnostic method of a refrigerator capable of sensing a power failure and notifying it to the user when the power failure occurs.

Furthermore, another technical task of the present disclosure is to provide a refrigerator capable of performing the foregoing diagnostic method.

In order to accomplish the foregoing technical task, according to an aspect of the present disclosure, there is provided a diagnostic method of a refrigerator, and the method may include checking whether or not a wireless network device provided in the refrigerator is connected in a wireless manner; sensing power supplied to the refrigerator when the wireless connection is disconnected; determining whether or not a power failure has occurred based on the sensed power; storing power failure occurrence information when it is determined that the power failure has occurred; referring to the power failure occurrence information when the power supply is resumed; storing power failure end information when the power failure occurrence information is found; and providing the power failure occurrence and power failure end information.

According to the foregoing aspect of the present disclosure, it is observed that the power of the refrigerator is maintained for about 10 seconds even when a power failure occurs and power supply is cut off, and thus it is checked in advance whether or not wireless connection provided at a place where the refrigerator is installed is carried out, and it is checked whether or not power is abnormal since the possibility of the power failure is high when the wireless connection is disconnected. If power supplied thereto is abnormal, then it is determined as a power failure, and the fact that the power failure has occurred is stored before power is turned off, thereby notifying the fact that the power failure has occurred to the user. Through this, the user may know the fact that there has been a power failure when he or she is out for a long period of time, and thus can take a proper action for the stored foods.

In other words, there may be an error in determining whether or not a power failure has occurred in case where power supply is temporarily unstable or a power measurement device of the refrigerator is abnormal, but a probability of detecting the power failure may be further increased when wireless connection through a wireless network adaptor is cut off, thereby increasing the accuracy of the determination through this.

Here, the power failure occurrence information may include only the fact itself that a power failure has occurred, or may include information on a time when it is determined that a power failure has occurred.

Similarly, the power failure end information may include the fact that the power failure has been terminated or may include information on an operation resumption time. Through this, the user may know for how many hours there has been a power failure, and more accurately determines whether or not to dispose the stored foods.

Furthermore, the power failure occurrence and end information may be displayed through a display means provided in the refrigerator or transferred to the outside through a communication network.

In other words, said providing the power failure occurrence and end information may include checking whether or not the wireless connection is carried out; transmitting the power failure occurrence and end information to an external server when the wireless connection is normal; and transmitting the power failure occurrence and end information from the external server to the side of the user's terminal.

Moreover, said providing the power failure occurrence and end information may include checking whether or not a wireless network is connected thereto; checking whether or not a previously registered user terminal is accessed on the wireless network; and transmitting the power failure occurrence and end information to the side of the confirmed user terminal.

Moreover, said sensing the power may be carried out by a power sensing element provided in the controller of the refrigerator or may be carried out by receiving measured power from a power controller provided at an outer portion of the refrigerator.

According to another aspect of the present disclosure, the refrigerator may include a refrigerator body configured to provide a storage space for storing foods therein; a cooling means configured to cool the storage space; a display device configured to display the operation state of the refrigerator; and a controller configured to control the cooling means and the refrigerator body, wherein the controller includes a wired and wireless communication means configured to communicate with an external device; and an information storage means configured to store power failure occurrence information, and the controller stores power failure occurrence information in the information storage means when a power failure has occurred, and transfers the stored power failure occurrence information to the user during the end of the power failure.

Here, the controller may transfer power failure end information along with the power failure occurrence information to the user during the end of the power failure.

Furthermore, the power failure occurrence information and power failure end information may include a time when the power failure has occurred or has been terminated.

Furthermore, the controller may transfer the power failure occurrence information to the user through the display device, or transfer the power failure occurrence information to an external server through a wired and wireless network, or transfer the power failure occurrence information directly to the user.

According to aspects of the present disclosure having the foregoing configuration, even when power supply is resumed in a circumstance that the user is unable to recognize a power failure since the occurrence of the power failure, the user may check it, thereby properly disposing the stored foods.

Furthermore, in determining whether or not a power failure has occurred, it may be taken into consideration at the same time whether or not another electronic device such as a wireless network is operated in addition to the refrigerator, thereby more accurately checking whether or not the power failure has occurred.

In addition, information on power failure occurrence and end may be transferred through a display unit to easily check the status information, or may be also transferred to the user's terminal through a wired and wireless network, thereby checking the operation state of the refrigerator even from a remote location.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a diagnostic method and a refrigerator having a diagnostic function according to an embodiment of the present disclosure will be described in detail with reference to the accompanying drawings.

Figure 1:
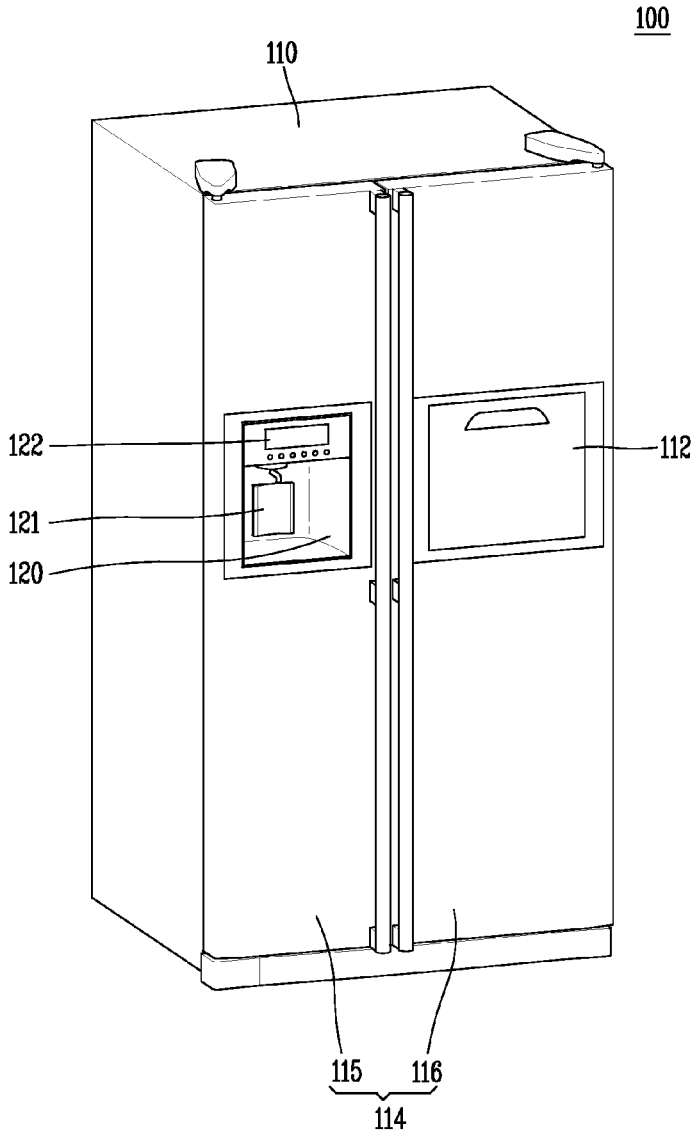
FIG. 1 is a cross-sectional view illustrating a refrigerator having a diagnostic function according to an embodiment of the present disclosure.

FIG. 1 is a cross-sectional view illustrating a refrigerator having a diagnostic function according to an embodiment of the present disclosure, and referring to FIG. 1, the refrigerator 100 may include a main body 110 formed with a storage space therein, a door 114 combined with the body 110 to open or close a front surface opening of the cooling chamber, and a dispenser 120 provided at the door 114. The cooling chamber may include a freezing chamber and a refrigerating chamber disposed in the left and right sides by interposing a partition wall, and the door 114 may include a freezing chamber door 115 and a refrigerating chamber door 116 revolvably mounted on the body 110 to open or close the freezing chamber and refrigerating chamber, respectively.

A dispenser 120 may be provided at a front surface of the freezing chamber door 115 to take out water and/or ice. The dispenser 120 is provided with a manipulation lever 121 as a manipulation means for taking out water or ice therein. Moreover, a display Unit 122 for displaying the operation status of the refrigerator is provided at an upper portion of the dispenser 120.

Furthermore, though not shown in the drawing, a cooling means for maintaining the freezing chamber and refrigerating chamber within a predetermined temperature range is provided at an inner portion of the body 110, and a typical evaporation-compression cycle apparatus may be used for the cooling means. The evaporation-compression cycle apparatus may include a compressor, a condenser, an expansion apparatus, and evaporator, but they are generally well known, and thus the detailed illustration and description thereof will be omitted.

Figure 2:
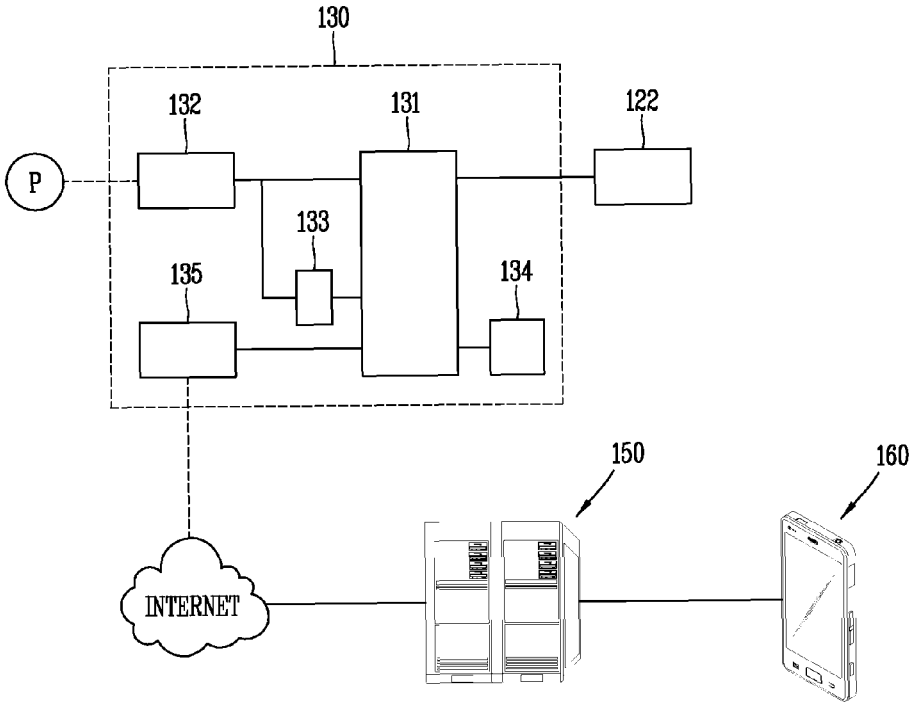
FIG. 2 is a block diagram schematically illustrating the configuration of a controller provided in FIG. 1.

On the other hand, the refrigerator 100 is provided with a controller 130 for controlling the operation of various convenient devices such as the cooling means and dispenser. FIG. 2 is a block diagram schematically illustrating the configuration of the controller 130, and referring to FIG. 2, the controller 130 may include a power supply device 132. The power supply device 132 receives an external power source (P), namely, a commercial alternating current power source, and outputs a direct current voltage for driving circuits, units and the like constituting the refrigerator and refrigerator controller. In general, a switched-mode power supply (SMPS) is used for the power unit 100. Of course, other types of power conversion devices may be also used in addition to the SMPS. The switched-mode power supply rectifies and smoothens an alternating current voltage of the external power source and converts it into a direct current voltage, and generates drive voltages required for the refrigerator and refrigerator controller using a transformer unit such as a high-frequency transformer, a regulator, and the like.

The direct current voltage converted by the power supply device 132 is supplied to a compressor of the cooling means as well as supplied to a main control unit 131 provided in the controller 130. The main control unit 131 has a form in which various electronic elements are mounted on the PCB, and includes an information storage means 134 for storing various information or programs required to control the refrigerator. The information storage means 134 may include a non-volatile memory element to maintain the stored information even during a power failure.

Moreover, the controller 130 may include a wireless network adaptor 135. Here, it may not be necessarily required to be a wireless network adaptor, and may be replaced by any communication means connected to an external device through a wired and wireless communication scheme to transmit information stored in the information storage means 134. The communication means may include all types of communication schemes capable of transmitting and receiving data such as power line communication, WIPI, Internet, Zigbee, serial communication, and the like.

The wireless network adaptor 135 is connected to an external server 150 through the Internet to transmit or receive the stored information, and the external server 150 is configured to transmit information received from the controller to the user's terminal 160. At this time, the information may be transferred to the terminal 160 through SMS or MMS, or an application programmed to receive the information and display it may be used when the terminal is a smart phone.

On the other hand, a power monitor unit 133 configured with electrical elements such as power semiconductors or transistors is provided between the power supply device 132 and the main control unit 131. The power monitor unit 133 monitors power supplied from the power supply device 132, and transfers it to the main control unit 131 when the power is out of the normal range. Here, the power monitor unit 133 may be provided in the refrigerator controller 130 as illustrated in FIG. 2, but may be also replaced by a separate device provided at an outer portion of the refrigerator.

In other words, it may be replaced by a smart meter provided on a lead-in line lead into a house from an external transformer to monitor power supplied thereto or a power measurement device provided at an individual wall outlet, and in this case, the main control unit is configured to receive information on power supplied from the smart meter or power measurement device.

Figure 3:
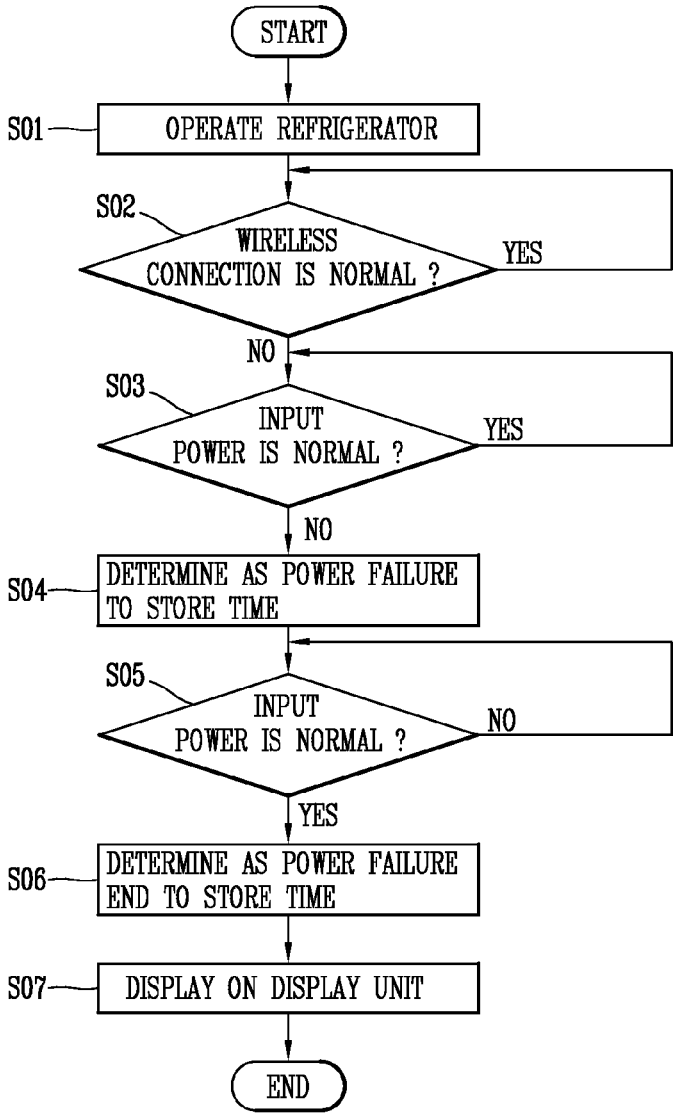
FIG. 3 is a flow chart illustrating a diagnostic method of the refrigerator according to an embodiment of the present disclosure.

Hereinafter, a refrigerator diagnostic method according to a first embodiment of the present disclosure will be described with reference to FIG. 3. When power is supplied from the outside and the refrigerator is operated (step S01), the main control unit 131 checks whether or not it is connected to a wireless network provided at a place where the refrigerator is installed through the wireless network adaptor 135 (step S02). The wireless network is provided to transfer various information to the refrigerator or on the contrary transmit information to an external server or terminal from the refrigerator, which denotes to Wi-Fi installed at home.

Here, checking whether or not the wireless network is normal is to more accurately determine whether or not a power failure has occurred, and in case of a power failure, the operation of a wireless router provided at home is suspended, and thus it may be possible to increase the accuracy compared to a case where it is determined only by the power monitor unit or smart meter. Of course, in case where whether or not a power failure has occurred can be accurately determined only by the power monitor unit or smart meter, the step S2 may be omitted.

When the wireless network is not connected, it is highly likely that a power failure has occurred, and thus whether or not power supply is normal is checked through the power monitor unit 133 or smart meter (step S03). If determined that power supply is abnormal, then it is determined that a power failure has occurred, and the time is stored in the information storage means 134 (step S04). In general, when a power failure has occurred, the operation of the relevant device is immediately suspended, but in case of a refrigerator, the processes of S03 and S04 can be carried out during the power failure since power is maintained for about 10 seconds even during the power failure.

Then, when power supply is resumed, the main control unit 131 checks whether or not power supplied through the power supply device 132 is normal, and in case of normal condition, it is determined that power supply has been resumed (step S06). At this time, a time at which power supply is resumed is stored in the information storage means 134, and then the fact that the power failure has occurred and the power failure occurrence time and power failure end time are displayed through the display unit 122 (step S07).

Through this, the user may know the fact that a power failure has occurred while he or she is out, and how long the power failure condition lasted, and those information will be helpful to determine whether to dispose the stored foods.

Figure 4:
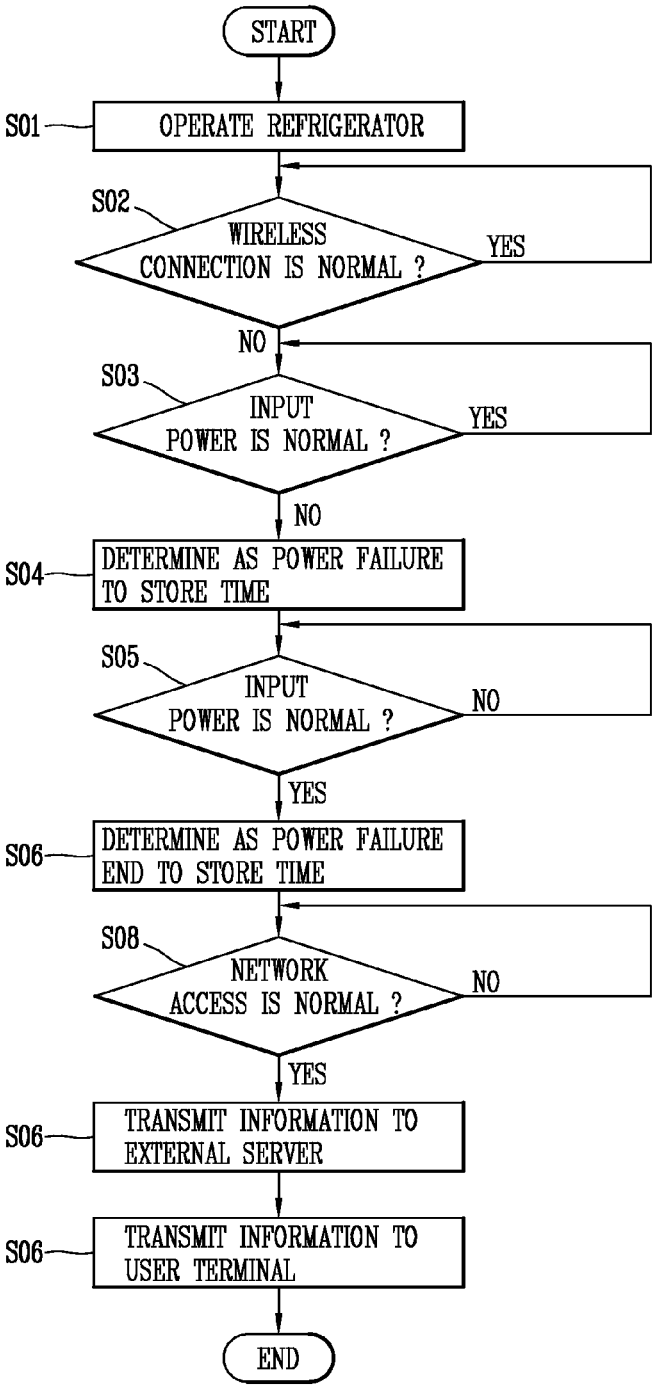
FIG. 4 is a flow chart illustrating a diagnostic method of the refrigerator according to another embodiment of the present disclosure.

Here, the step S07, namely, a method of providing information associated with the power failure may be replaced with another method. In other words, as illustrated in FIG. 4, an example of determining whether the network access is normal after starting power supply (step S08) to transmit the fact that a power failure has occurred and the power failure occurrence time and power failure end time to the external server 150 specified in advance (step S09), and transmitting the transmitted information to the user terminal (S10), thereby allowing the user to know whether or not a power failure has occurred and the duration time may be taken into consideration.

Here, the network in the step S08 may not be necessarily required to be connected through a wireless router provided at home, and may be a network provided by any wired and wireless communication means.

What is claimed is:

1. A diagnostic method of a refrigerator, the method comprising:

checking whether or not a wireless network device provided in the refrigerator is connected to a wireless network provided at a place where the refrigerator is installed;

sensing power supplied to the refrigerator when the wireless connection is disconnected;

determining whether or not a power failure has occurred based on the sensed power;

storing power failure occurrence information when it is determined that the power failure has occurred;

referring to the power failure occurrence information when the power supply is resumed;

storing power failure end information when the power failure occurrence information is found; and providing the power failure occurrence and power failure end information to a user's terminal at an end of the power failure.

2. The method of claim 1, wherein the power failure occurrence information comprises information on a time when it is determined that a power failure has occurred.

3. The method of claim 1, wherein the power failure end information comprises information on an operation resumption time.

4. The method of claim 1, wherein the power failure occurrence and end information are displayed through a display means provided in the refrigerator.

5. The method of claim 1, wherein said providing the power failure occurrence and end information comprises:

checking whether or not the wireless connection is carried out;

transmitting the power failure occurrence and end information to an external server when the wireless connection is normal; and transmitting the power failure occurrence and end information from the external server to the side of the user's terminal.

6. The method of claim 1, wherein said providing the power failure occurrence and end information comprises:

checking whether or not a wireless network is connected thereto;

checking whether or not a previously registered user terminal is accessed on the wireless network; and transmitting the power failure occurrence and end information to the side of the confirmed user terminal.

7. The method of claim 1, wherein said sensing the power is carried out by a power sensing element provided in the controller of the refrigerator.

8. The method of claim 1, wherein said sensing the power comprises:

receiving measured power from a power controller provided at an outer portion of the refrigerator.

9. A refrigerator having a diagnostic function, the refrigerator comprising:

a refrigerator body configured to provide a storage space for storing foods therein;

a cooling means configured to cool the storage space;

a display device configured to display the operation state of the refrigerator; and a controller configured to control the cooling means and the refrigerator body, wherein the controller comprises:

a wired and wireless communication means configured to communicate with an external device; and an information storage means configured to store power failure occurrence information, and wherein the controller is configured to:

check whether or not the wired and wireless communication means is connected to a wireless network provided at a place where the refrigerator is installed;

sense power supplied to the refrigerator when the wired and wireless connection is disconnected;

determine whether or not a power failure has occurred based on the sensed power;

store power failure occurrence information in the information storage means when a power failure occurred;

refer to the power failure occurrence information when the power supply is resumed;

transfer the stored power failure occurrence information to the user at an end of the power failure; and store power failure end information when the power failure occurrence information is found.

10. The refrigerator of claim 9, wherein the controller transfers power failure end information along with the power failure occurrence information to the user at the end of the power failure.

11. The refrigerator of claim 10, wherein the power failure occurrence information and power failure end information comprises a time when the power failure has occurred or has been terminated.

12. The refrigerator of claim 9, wherein the controller transfers the power failure occurrence information to the user through the display device.

13. The refrigerator of claim 9, wherein the controller transfers the power failure occurrence information to a previously specified external server through a wired and wireless network.

* * * * *